United States Patent [19]

Campergue et al.

[11] Patent Number: 4,934,103

[45] Date of Patent: Jun. 19, 1990

[54] MACHINE FOR ULTRASONIC ABRASION MACHINING

[75] Inventors: Gérard Campergue, La Ferte Alais; Roger Gouhier, Chatenay Malabry; Dominique Horriere, Vincennes; Alain Thiriot, Chatillon, all of France

[73] Assignee: Office National d'Etudes et de Recherches Aerospatiales O.N.E.R.A., Chatillon Sous Bagneux, France

[21] Appl. No.: 255,449

[22] Filed: Oct. 11, 1988

[51] Int. Cl.[5] ..... B24B 1/04

[52] U.S. Cl. ..... 51/59 SS

[58] Field of Search ..... 51/59, 59 SS, 165.71, 51/157, 58, 281 R, 55; 29/33 R

[56] References Cited

U.S. PATENT DOCUMENTS

| | | | |
|---|---|---|---|
| 2,947,886 | 8/1960 | McGunigle | 51/59 SS |
| 3,683,470 | 8/1972 | McMaster | 51/59 SS |
| 3,699,719 | 10/1972 | Rozdelsky et al. | 51/59 SS |
| 4,100,701 | 7/1978 | Bessaguet | 51/59 SS |
| 4,343,111 | 8/1982 | Inoue | 51/59 SS |
| 4,734,964 | 4/1989 | Lane et al. | 51/59 SS |
| 4,751,916 | 6/1988 | Bory | 51/59 SS |
| 4,828,052 | 5/1989 | Duron et al. | 51/59 SS |

FOREIGN PATENT DOCUMENTS 8903278 4/1989 World Int. Prop. O. ..... 51/59 SS

*Primary Examiner*—Frederick R. Schmidt
*Assistant Examiner*—Blynn Shideler
*Attorney, Agent, or Firm*—Larson and Taylor

[57] ABSTRACT

Machine for ultrasonic abrasion machining of the type comprising an assembly (1) supporting the parts (p) to be machined; a vibrating assembly (9) ending in a tool-holder (12) and adapted to drive the tool (8) with a reciprocal movement at ultrasonic frequency and to communicate these vibrations to an abrasive machining liquid; a system for the controlled descent of the tool towards the part to be machined, the attacking surface of the tool (8) being perpendicular to the axis of the tool-holder (12), so that the ultrasonic abrasion machining is carried out at the tool end; a device for regulating the downward movement of the tool; and, between the vibrating assembly (9) and a fixed frame (4), acousto-mechanical filters (20) disposed at longitudinal amplitude nodes (21, 22) of the vibrations, characterized in that an acousto-mechanical filter (20) is formed essentially of two concentric rings (23, 24) connected together by equidistant bridges (25), the inner ring (24) being deformable resiliently under the effect of the radial vibrations.

5 Claims, 4 Drawing Sheets

MACHINE FOR ULTRASONIC ABRASION MACHINING

The present invention relates to a machine for machining by ultrasonic abrasion, particularly for machining insulating, hard, friable or brittle materials such as glass, quartz, silicon carbide, alumina or when the machined parts to be obtained have fairly complicated shapes. In such a machine a "sonotrode" is used having at the end a tool which communicates ultrasonic vibrations to an abrasive in suspension in a liquid. These vibrations cause micro-hammering of the part to be machined and erosion thereof. The tool, whose shape is that of the impression which it is desired to form, penetrates into the part, reproducing its own shape therein.

Generally, such a machine comprises:

a support assembly for the part to be machined;

a vibrating assembly ending in a tool-holder and able to drive the tool with a reciprocal movement at ultrasonic frequency and to communicate these vibrations to a liquid machining abrasive;

a system for controlling the descent of the tool into the part to be machined;

the attacking surface of the tool being perpendicular to the shaft of the tool-holder so that machining by ultrasonic abrasion is caused at the tool end;

a device for regulating the descent of the tool; and between the vibrating assembly and a fixed frame acousto-mechanical filters disposed at nodes of longitudinal amplitude of the vibrations.

Because of this arrangement of the acousto-mechanical filters, the vibrating assembly is perfectly immobilized in elongation but it should also be considered that in each sector the harmonic longitudinal vibration is accompanied by a radial vibration in phase quadrature. Such radial vibration has an antinode amplitude loop at this fixing point. It is consequently absolutely necessary to perfectly decouple the vibrating assembly from the frame so as not to transmit its radial vibrations thereto.

The main aim of the present invention is to provide an acousto-mechanical filter which satisfies this additional condition.

For this, a machining machine of the type defined at the beginning will, in accordance with the present invention, be essentially characterized in that an acousto-mechanical filter is formed essentially of two concentric rings connected together by equidistant bridges, the inner ring being deformable resiliently under the effect of the radial vibrations.

Another aim of the present invention is to obtain perfect regulation of the conditions for machining the part to be machined, particularly in so far as the machining depth and the pressure exerted by the tool on the part are concerned.

For this, the machine will be further characterized in that the device for regulating the descent of the too essentially comprises, for keeping the gap between the tool and the machining surface as well as the pressure exerted by the tool on the surface to be machined at a constant value, a force sensor of the capacitive type for controlling, through an electronic regulation chain, a motor controlling the vertical movement of a mobile assembly carrying the vibrating assembly.

Another drawback of the machines of the prior art resides in the fact that the construction of tools with complex shapes—for obtaining machined parts also having complex shapes—is costly and requires long manufacturing times. Furthermore, it has proved that the too wears out rapidly and that the shapes which can be obtained are limited in fineness and dimensions.

Finally, it will be readily understood that the price of the tool increases rapidly with the dimensions of the parts to be formed.

Another aim of the present invention is to eliminate these other drawbacks of the prior art, and particularly to obtain a machine for ultrasonic abrasion machining which makes it possible to obtain impressions of complex shapes without having to rely on a specific costly tool limited in so far as its precision and dimensions are concerned.

For this, an ultrasonic abrasion machining machine in accordance with the present invention, for machining by shaping, may be further characterized in that it comprises a digital movement control device for moving the part to be machined with respect to the tool in two directions perpendicular to each other and perpendicular to the shaft of the tool-holder.

With this arrangement and those which precede, it will be understood that the tool may have a very simple geometrical shape and have particularly reduced dimensions, since it is by the relative movements between the attacking surface of the tool and the part to be machined, in two directions perpendicular to each other, that the desired complex machining shapes may be obtained and not, as in the prior art, by having to confer on the tool said desired complex shapes. The tool will therefore be inexpensive and may be formed very rapidly. It is also important to notice that the tool may be the only required whatever the shape to be obtained, since machining by shaping can be obtained with the invention.

With the device providing movement in two dimensions, the tool may for example form a closed circuit groove around the periphery to be cut out or by sweeping over the surface to be hollowed out. It will also be possible to make an open circuit groove on the part to be machined by terminating the loop of the circuit outside the part when the grooving extends beyond the edge of the part. When the grooving is limited to inside the part, the movement system may be driven reciprocally.

When a machining circuit or sweep has been carried out on the part to be machined, another pass may be accomplished, after lowering the tool, by following the same circuit or the same sweep trace, and thus obtaining machining over the desired depth in as many successive passes as will be necessary.

A machine of the invention, namely constructed according to the general principles set out above, may have a number of complementary characteristics and advantages, which will appear from reading the embodiment given below by way of non limitative example.

The following description refers to the figures of the accompanying drawings in which.

Figure 2:
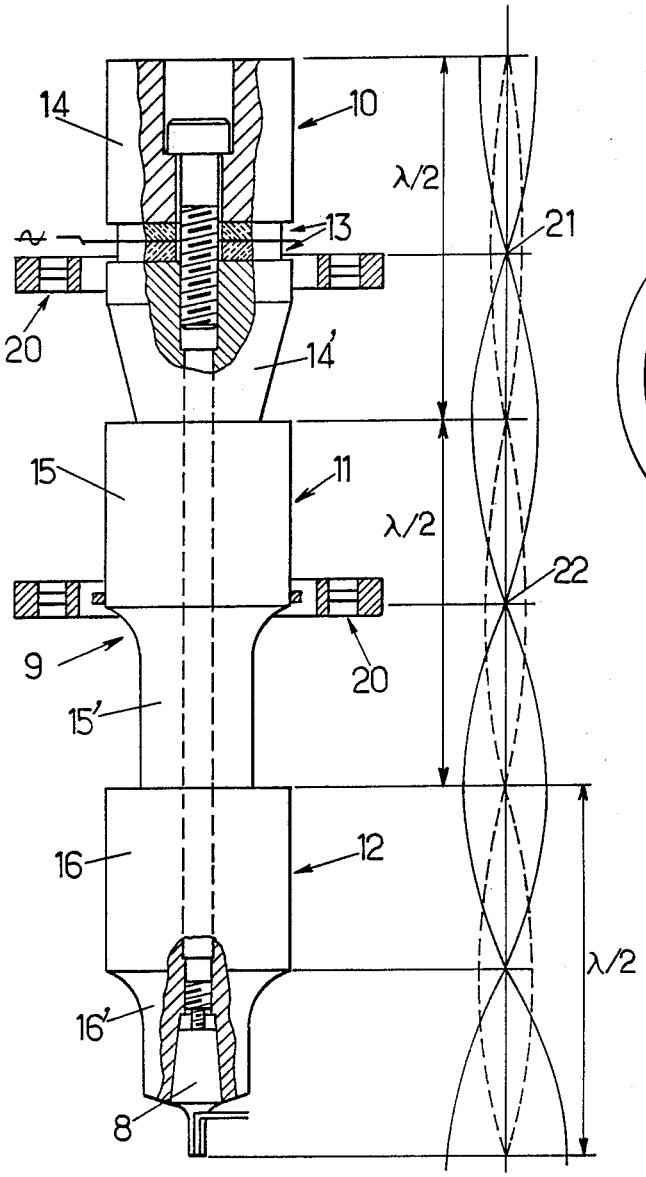
FIG. 2 shows the vibrating assembly of the machine of FIG. 1.
Figure 2A:
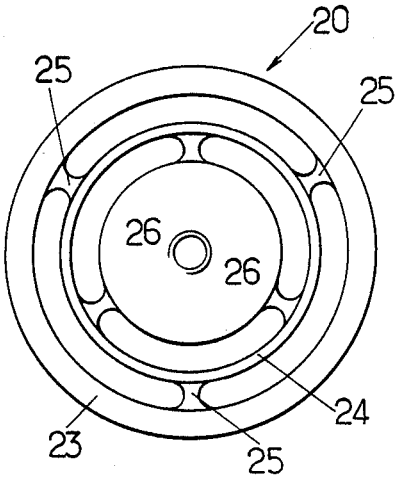
Figure 3:
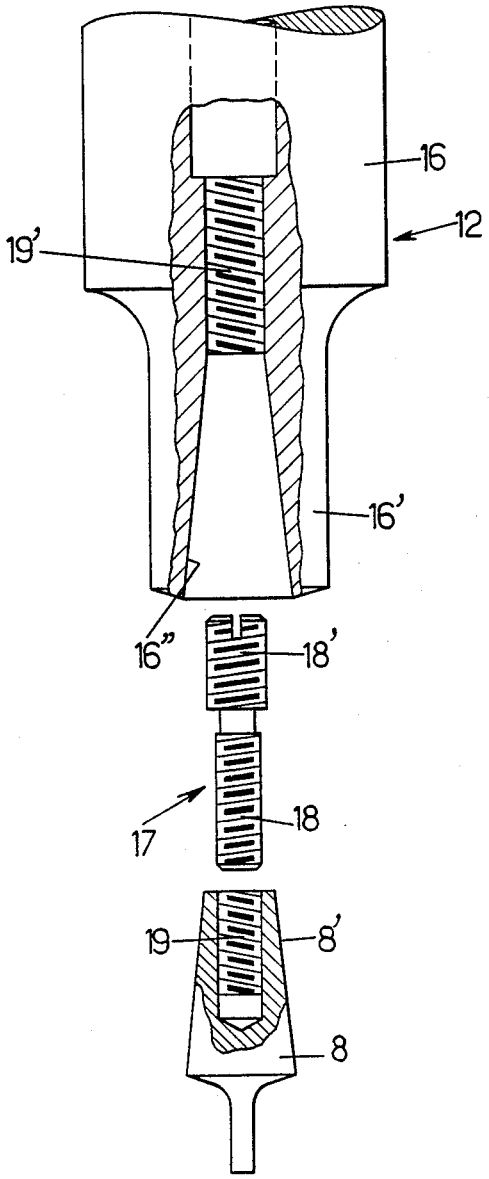
Figure 4:
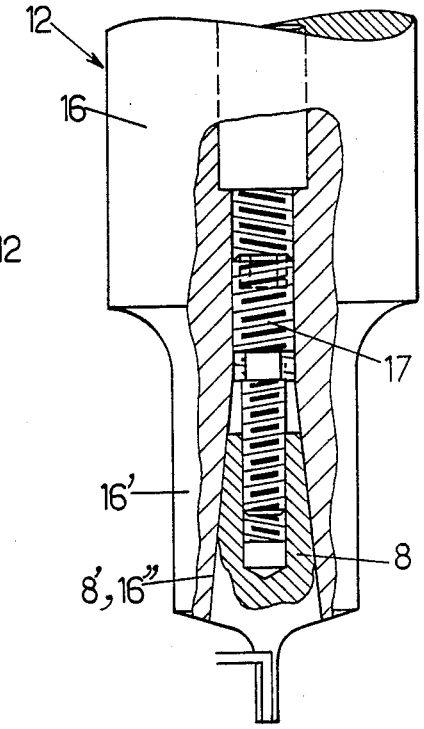
Figure 5:
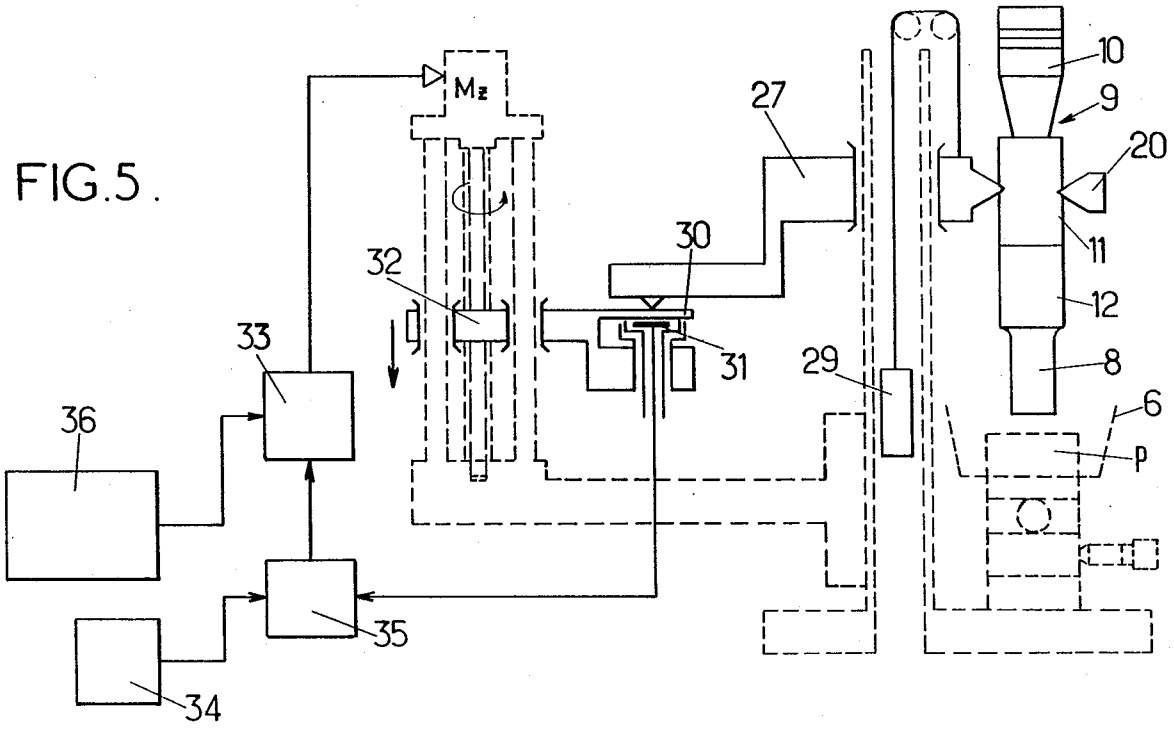

FIG. 2*a* is a top view of an acousto-mechanical filter:

FIG. 3 shows the connection means between the tool-holder and the tool, with partial axial sections of these parts;

FIG. 4 shows the tool and the tool-holder assembled, with partial axial sections; and FIG. 5 is a general diagram of the system for controlled lowering of the tool.

Figure 1:
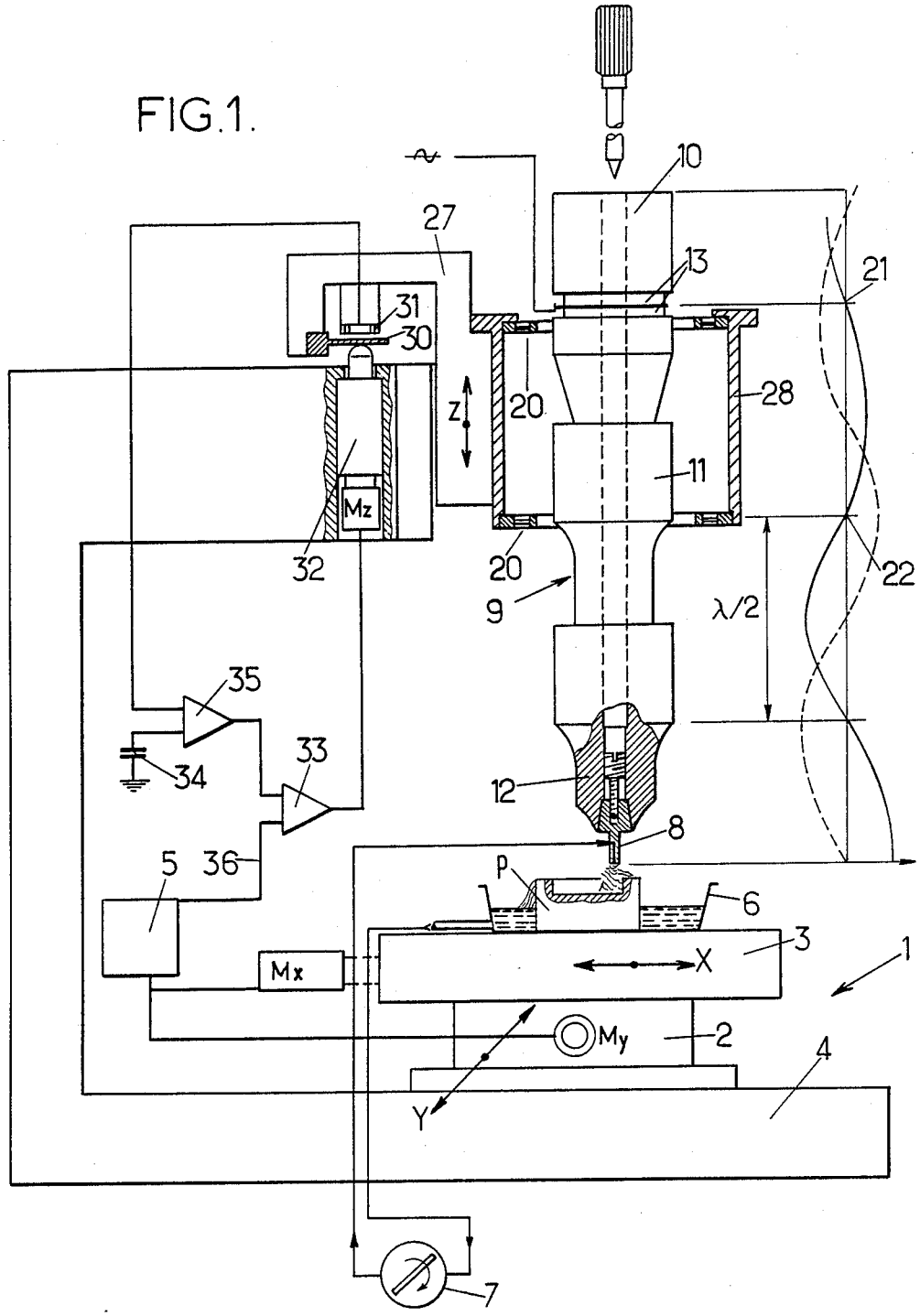
FIG. 1 is a general schematic view in elevation of an ultrasonic milling machine in accordance with the invention.

In FIG. 1, a support assembly has been referenced at 1 intended to carry the parts p to be machined. It is a question of an assembly with movements X, Y, namely that it is formed of two tables 2 and 3, one (2) of which may move with respect to a fixed frame 4 in a horizontal direction Y and the other (3) of which may move with respect to the preceding one in a horizontal direction X perpendicular to direction Y. Between table 2 and the fixed frame 4, as well as between table 2 and table 3. high precision sliding may be obtained by any known appropriate means, e.g. by means of dovetail slides.

The position of tables 2 and 3 is detected at all times by optical reading displacement sensors (not shown). The movement of these tables is obtained through electric motors My and Mx controlled by a computer 5.

The part to be machined p is disposed in a spraying tank 6 for recovering the abrasive liquid, which contains a metal plate supporting the part to be machined p. As can be seen in FIG. 1, the abrasive liquid is caused to flow by a pump 7 which takes the liquid from tank 6 and reinfects it therein through the tool, which has been referenced at 8.

FIG. 2, which is a part of FIG. 1 shown on a larger scale and in a more detailed way, shows the vibrating assembly, referenced generally at 9.

This vibrating assembly is formed of a stack of three separate cylindrical portions 10, 11 and 12, each of length $\lambda/2$, $\lambda$ being the wavelength of the vibrations.

The first portion 10 is formed of a transducer which comprises two piezoelectric ceramic inserts 13 (lead zirconate titanate PZT) pre-stressed between two titanium cylinders 14, 14' of identical weights and lengths equal to $\lambda/4$.

The second portion 11 is a longitudinal vibration amplitude matcher; it is either made from titanium, or form duralumine, having a bicylindrical shape and of a length equal to twice $\lambda/4$. The square of the ratio of the diameters of the two sections 15, 15' which form it define the matching ratio.

The third portion 12 is a second matcher more commonly called "sonotrode" and ends in the machining tool 8. Like the second portion 11 it is generally of a bicylindrical shape and made from the same material. The ratio between the diameters of the two portions 16, 16' which form it this time depends on the shape and the weight of tool 8, whether this latter is formed in one piece with the sonotrode or fastened thereto.

In FIGS. 3 and 4, there has been shown the way in which the connection between tool 8 and the sonotrode 12 may be formed. This connection is provided by a Morse taper fitting with a taper equal to 5%, a portion of the external tapered surface 8' of the tool 8 fitting into a hollow of corresponding shape 16'' in the end part 16' of the sonotrode 12. Such locking is held by a bicylindrical stud 17 with two differential threads 18, 18'. The fine pitch thread 18' of the large diameter upper part of the stud engages in a corresponding tapped hole 19' in sonotrode 12, whereas the largest pitch thread 18 of the lower smaller diameter part of the stud engages in a corresponding tapped hole 19 in portion 8' of the tool, This connection system has the advantage of increasing the contact area between the sonotrode 12 and tool 8, and so of allowing a better transmission of the vibrations to the tool, while ensuring an excellent axial coincidence thereof.

Furthermore, it makes it easy to set the vibrating assembly 9, which has just been described, to the resonance frequency, by slightly moving stud 17 in its housing, which avoids having to adjust the length of the sonotrode by trial and error.

In FIG. 1 and in a more detailed way in FIG. 2, a system has also been shown for decoupling between the vibrating assembly 9 and the frame 4 of the machine, this system being intended to stop the ultrasonic vibrations at the connection between the vibrating assembly and the frame, while maintaining this vibrating assembly perfectly perpendicular to the surface to be machined, In FIGS. 1 and 2 the amplitude of the longitudinal vibrations of the vibrating assembly has also been shown (with a continuous line), as well as the amplitude of the radial vibrations (with broken lines).

As shown in particular in FIG. 2, when the assembly oscillates in its own mode, fixing to the frame is made at a longitudinal amplitude node of the vibration. The vibrating assembly is perfectly immobilized in elongation.

As mentioned above, to obtain the desired radial decoupling, acousto-mechanical filters 20 may advantageously be used, shown in profile in FIG. 2 and in a top view in FIG. 2*a*, and which are disposed, in accordance with what has just been explained above, at longitudinal amplitude nodes (21 and 22) of the vibrations. Each electro-acoustic filter 20 is formed of two concentric rings 23, 24 connected together by three equidistant bridges 25 and connected to the matcher by three other equidistant bridges 26 offset from the first by 60°. The inner ring 24 is deformable resiliently by the radial vibrations. The more massive outer ring 23 is connected to a mobile assembly 27 of the frame by a flange 28 (FIG. 1).

The machine further comprises, as already mentioned at the beginning, a device for regulating lowering of the tool 8 for maintaining the distance between the attacking surface of the tool and the surface to be machined constant.

This device is shown partially in FIG. 1 but its general diagram is shown in FIG. 5. In these two figures the same references have been used as much as possible to designate the same elements or members of the device, So that the gap between the tool and the assembly surface remains constant, with a constant pressure on the surface to be machined, it is obviously advisable for tool 8 to move down into part p as the latter is hollowed out. The effect of gravity is used acting on an adjustable counterweight and lever arm system shown schematically at 29, supporting the mobile assembly 27 to which the vibrating assembly 9 is fixed.

This solution is valid when the machining surface is large; in this case, the counterweights are large, of about a kilogram. But when the machining surfaces are small and when, in addition, a high degree of fineness of execution is desired, the weights used are such that they do not compensate for the friction of the articulation shafts of the lever arm and those of the torque of the guide pulleys. The system is then stopped by the dry friction of the assembly, and it is then necessary to load unduly with weight, which results in considerable scaling and even breakage of the part. In addition, during the lowering of the tool it happens that the abrasive does not flow evenly or that the abrasive concentration changes There follows a slowing down, even stopping of the descent. All the pressure is then transmitted to the part and there is immediate breakage To avoid such drawbacks. a force sensor is provided which corrects the downward speed. The force sensor is formed of a blade 30 embedded at one end and which forms one electrode of a capacitor. All the weight of the mobile system 9-27 rests on this blade 30 when the machine operates correctly. Opposite this electrode is disposed a capacitive sensor which comprises a detection electrode 31, forming the other electrode of the capacitor associated with deformation of the blade 30. An electronic chain, with bridge imbalance, corrects the downward speed of the stop.

When the assembly speed slows down, for one of the above mentioned reasons, blade 30 of the sensor is slightly relieved and the interelectrode distance (blade-sensor) increases. The system reacts by slowing down the descent motor Mz.

In FIGS. 1 and 5 there are further referenced at:

32, a mobile stop driven by motor Mz and supporting the embedded blade 30;

33, an amplifier controlling the motor Mz;

34, a capacitor with reference capacity;

35, a comparator of the bridge imbalance type controlling the amplifier 33; and

36, a mean speed reference.

Such being the case, it has been discovered that the invention has the following important advantages:

the attacking surface of the tool is perpendicular to the shaft of the sonotrode and it remains at a constant distance from the part to be machined, this distance depending on the size of the grains of abrasive used and on the amplitude of the ultrasonic vibrations, which confers an excellent quality of finish on the part formed;

adjustment of the distance between the attacking surface of the tool and the surface of the part to be machined is obtained through a force sensor giving the minimum contact pressure of the tool on the part through the moving abrasive charge;

the tool may be made from very hard and resistant materials, for example from polycrystalline diamond considering its simple shape. It therefore has much less wear for equivalent work, which makes possible an increase in assembly accuracy;

there is no acoustic impedance matching at each tool change (standard sonotrode);

the vibrating assembly, from the piezoelectric inserts to the tool, may be made in one piece. This one piece assembly, without solution of continuity by studs, inevitable in the conventional assembly method, allows the best possible transmission of vibrations to the tool:

it is possible to produce an "ultrasonic kit" adaptable to any machine tool with digital control;

the dimension of the parts is no longer limited by the machine but by the length and precision of movement of tables X, Y. This limit is generally less constraining than that of the power; and in machining by shaping, an object of the present invention, tool 8 which is generally cylindrical is perfectly concentric with the sonotrode 12.

We claim:

1. Machine for ultrasonic abrasion machining of the type comprising an assembly (1) supporting the parts (p) to be machined; a vibrating assembly (9) ending in a tool-holder (12) and adapted to drive the tool (8) with a reciprocal movement at ultrasonic frequency and to communicate these vibrations to an abrasive machining liquid; a system for the controlled descent of the tool towards the part to be machined, the attacking surface of the tool (8) being perpendicular to the axis of the tool-holder (12), so that the ultrasonic abrasion machining is carried out at the tool end; a device for regulating the downward movement of the tool; and, between the vibrating assembly (9) and a fixed frame (4), acousto-mechanical filters (20) disposed at longitudinal amplitude nodes (21, 22) of the vibrations, characterized in that an acousto-mechanical filter (20) is formed essentially of two concentric rings (23, 24) connected together by equidistant bridges (25), the inner ring (24) being deformable resiliently under the effect of the radial vibrations and said acousto-mechanical filters including a plurality of equidistant second bridges connecting the inner ring to the vibrating assembly.

2. Machine according to claim 1, characterized in that the connection and relative centering between the tool-holder (12) and the tool (8) are provided by means of a stud (17) having two threaded portions (18, 18') one of these threaded portions (18') being engaged in a tapped hole (19') in the tool-holder (12), whereas the other threaded portion (18) is engaged in a tapped hole (19) in the tool (8), the latter being engaged and centred in the tool-holder (12) by a tapered fit (8', 16'').

3. Machine according to claim 1, characterized in that the device for regulating the downward movement of the tool (8) comprises essentially, for maintaining the gap between the tool and the machining surface as well as the pressure exerted by the tool (8) on the surface to be machined at a constant value, a force sensor of capacitive type (30, 31) adapted for controlling, through an electronic regulation chain (33-36), a motor (Mz) controlling the vertical movement of a mobile assembly (27) supporting the vibrating assembly (9),

4. Machine according to claim 3, characterized in that said mobile assembly (27) bears on an embedded blade (30) which forms, with an electrode (31), said force sensor (30, 31).

5. Machine according to claim 1 for machining parts by shaping, characterized in that it comprises a digital displacement control device for moving the part to be machined (p) with respect to the tool (8) in two directions (X, Y) perpendicular to each other and perpendicular to the axis of the tool-holder (12).

* * * * *